US012331955B2

(12) United States Patent
Charming et al.

(10) Patent No.: US 12,331,955 B2
(45) Date of Patent: Jun. 17, 2025

(54) AIR HANDLING UNIT WITH MOVABLE COILS

(71) Applicant: Smithgroup Companies, Inc., Detroit, MI (US)

(72) Inventors: Elena Gowdy Charming, Arlington, VA (US); Ionel Petrus, Silver Spring, MD (US)

(73) Assignee: SMITHGROUP COMPANIES, INC., Detroit, MI (US)

( * ) Notice: Subject to any disclaimer, the term of this patent is extended or adjusted under 35 U.S.C. 154(b) by 187 days.

(21) Appl. No.: 18/178,173

(22) Filed: Mar. 3, 2023

(65) Prior Publication Data

US 2024/0295341 A1 Sep. 5, 2024

(51) Int. Cl.
*F24F 13/30* (2006.01)
*F24F 3/06* (2006.01)

(52) U.S. Cl.
CPC ..... *F24F 13/30* (2013.01); *F24F 3/06* (2013.01)

(58) Field of Classification Search
CPC ..... F24F 1/0059; F24F 1/0063; F24F 1/032; F24F 1/0323; F24F 11/81; F24F 11/83; F24F 13/30
See application file for complete search history.

(56) References Cited

U.S. PATENT DOCUMENTS 4,239,518 A * 12/1980 Steelman ..... A47F 3/0408 62/282
4,750,544 A * 6/1988 Halsne ..... F24F 11/72 165/286
4,971,139 A * 11/1990 Khattar ..... F24F 12/002 165/96
5,237,831 A * 8/1993 Sikora ..... F24F 1/022 62/159
7,581,619 B1 9/2009 Storm
8,616,265 B2 * 12/2013 Fell ..... B60K 11/04 165/41
10,921,015 B2 * 2/2021 Rajendran ..... F24F 13/30
11,246,241 B1 * 2/2022 Ross ..... F24F 1/0063
2006/0005959 A1 * 1/2006 Maeda ..... F28D 1/05366 165/103
2018/0100671 A1 * 4/2018 Snider ..... F24F 11/72
2020/0103131 A1 * 4/2020 Bhosale ..... F24F 1/0063

FOREIGN PATENT DOCUMENTS

EP 2172715 A2 4/2010

* cited by examiner

*Primary Examiner* — Jonathan Bradford
(74) *Attorney, Agent, or Firm* — Brooks Kushman P.C.

(57) ABSTRACT

A building air handling unit includes a housing defining an air passageway, and a plurality of coil banks arranged in layers of adjacent pairs within the air passageway. At least some of the adjacent pairs are swivel mounted with the housing and may rotate relative to the housing to alter orientation of the at least some of the adjacent pairs relative to flow of air through the air passageway.

4 Claims, 2 Drawing Sheets

AIR HANDLING UNIT WITH MOVABLE COILS

TECHNICAL FIELD

This disclosure relates to building air handling equipment.

BACKGROUND

Buildings may be located in a variety of climate zones. As such, interior conditions may vary depending on season, sun exposure, etc. Various conditioning equipment may thus be used to cool and/or heat interior air to improve occupant comfort. Energy is often consumed when operating this conditioning equipment.

SUMMARY

An air handling system for a building includes a building air handling unit having a support structure defining an air passageway, a coil bank mounted with the support structure and configured to direct a fluid therethrough, and at least one actuator configured to move the coil bank relative to the support structure to change an effective amount of surface area of the coil bank positioned normal to flow of air through the air passageway.

A building air handling unit includes a housing defining an air passageway, and a plurality of coil banks arranged in layers of adjacent pairs within the air passageway. At least some of the adjacent pairs are swivel mounted with the housing and configured to rotate relative to the housing to alter orientation of the at least some of the adjacent pairs relative to flow of air through the air passageway.

A method for controlling an air handling system includes, responsive to a request for conditioned air, generating by a controller a command for an actuator to swivel a coil bank within an air passageway of a building air handling unit to reduce an effective amount of surface area of the coil bank positioned normal to flow of air through the air passageway.

DETAILED DESCRIPTION

Figure 1:
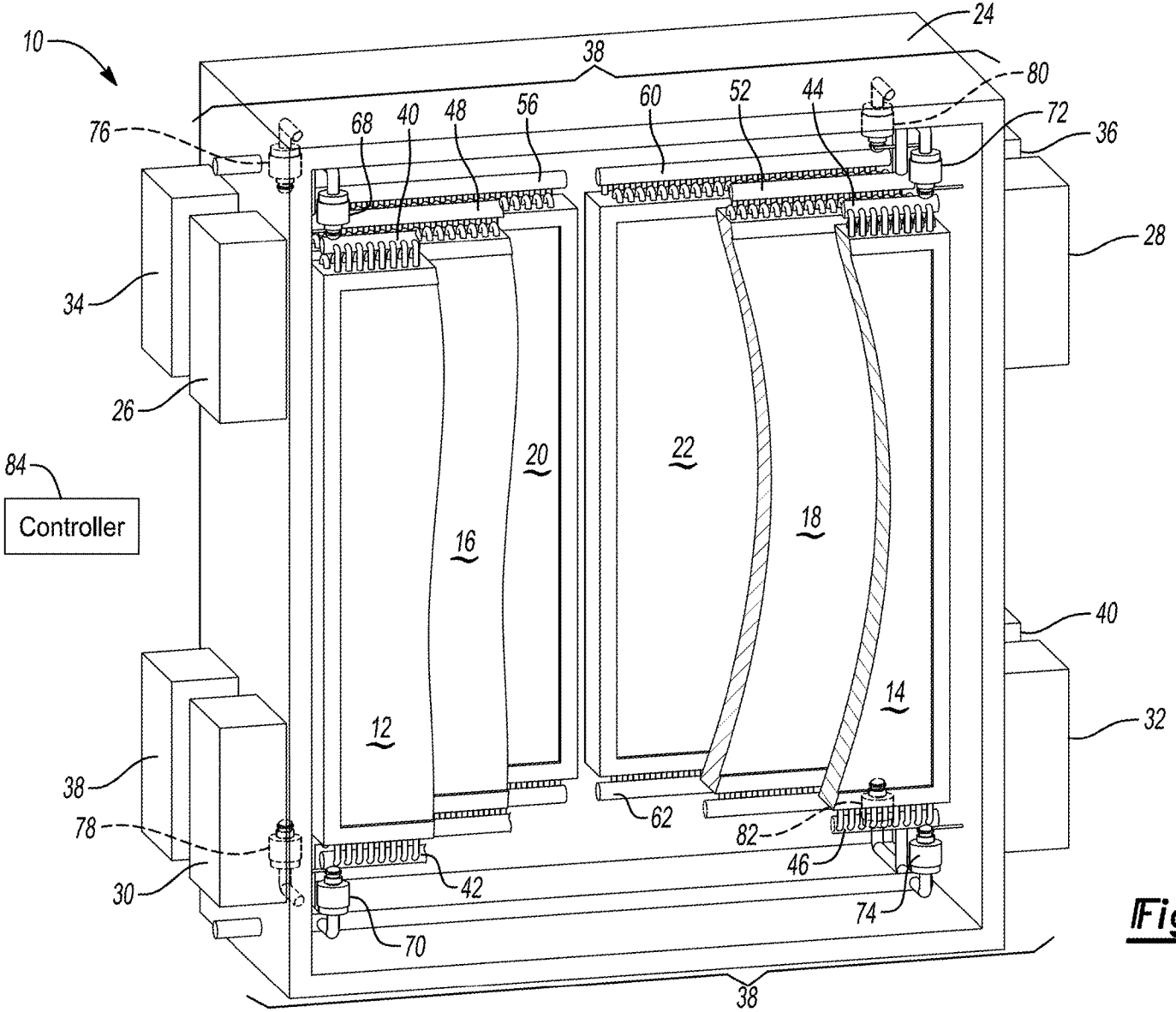
FIG. 1 is a perspective view of a portion of an air handling unit with all coil banks positioned within the air flow path.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

An air handling unit (AHU) can be a central system that provides cooling, heating, and ventilation for buildings. It is a typical piece of equipment for maintaining an indoor environment that is comfortable for building occupants.

An AHU is often located in a mechanical room of a building and, in certain implementations, can include several components that work together to provide clean, conditioned air to the building. These components may include filters, heating and colling coils, fans, dampers, humidifiers/dehumidifiers, and energy recovery ventilators.

Filters remove unwanted particles, such as dust, dirt, and bacteria, from air that is to be supplied to the building. This may ensure that the air entering the building is clean for building occupants.

Heating and cooling coils respectively heat or cool the air as it passes through the AHU. A heating coil is typically made of copper or aluminum and contains a hot fluid that warms the air as it passes over the coil. A cooling coil is typically made of the same materials and contains a chilled fluid that cools the air as it passes over the coil.

Fans move the air through the AHU. Examples of such fans include centrifugal fans and axial fans, which are typically driven by an electric motor. The fans create the necessary air flow to distribute conditioned air throughout the building.

Dampers regulate the flow of the air into and out of the AHU. They can be adjusted to control the amount of air entering the building and to maintain the desired indoor air quality.

Humidifiers add moisture to the air if the indoor air is too dry. Dehumidifiers remove moisture from the air if the indoor air is too humid. These options may help maintain a comfortable indoor environment.

Energy recovery ventilators recover energy from the air that is being exhausted from the building. This may reduce energy costs and improve the efficiency of the AHU.

Once the air has been conditioned and filtered via an AHU, it can be distributed throughout the building through a system of ducts. The ducts are connected to diffusers or grilles that are located in various parts of the building. The diffusers or grilles are used to distribute the conditioned air into the building, while return air ducts are used to collect the air that has been used for return to the AHU for reconditioning.

An AHU can be controlled by a building management system to regulate the temperature and air quality in the building. The building management system is typically programmed to maintain a desired indoor air quality and to ensure that the building's heating and cooling systems are operating efficiently.

The capacity of an AHU may be defined by the volume of air that can pass therethrough while being conditioned. Fan size and associated motor power, and the surface area of coils may influence its capacity. Typically, coils are fixedly mounted within the air flow path such that regardless of the amount of cooling/heating required, the air will be forced to flow over all the banks of coils. Even in circumstances in which minimal cooling/heating is required and thus fluid is only circulating in fewer than all of the banks, the air will be forced to flow over all the banks. This may reduce efficiency as motor power will be required to flow the air over all banks even though they may not be in use.

Here we contemplate an AHU with moveable banks of coils. The banks may thus be positioned within the air flow path to facilitate thermal exchange, or largely removed from the air flow path when not being used to reduce power required to move the air through the AHU. In some examples, the banks may be slid into or out of the flow path via a mechanical arm or like mechanism, similar to a VCR tape being inserted into and then removed from a VCR player or a pocket door being slid into and out of a doorway. In other examples, the banks may be rotated into or out of the flow path via gearing, or other links, similar to a rotating sign or western-style door. Other configurations are also contemplated.

Figure 2:
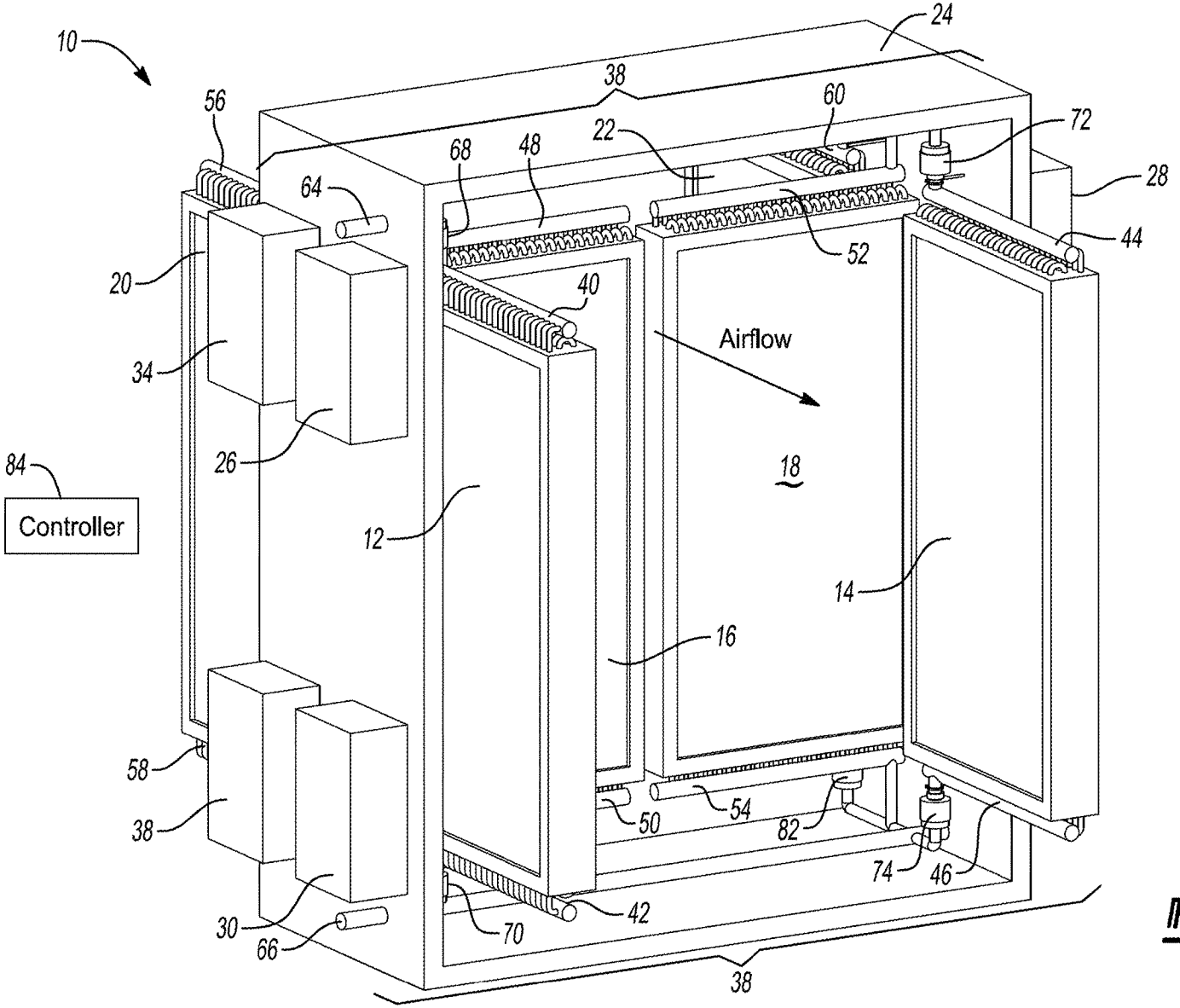
FIG. 2 is another perspective of the portion of the air handling unit of FIG. 1 with some coil banks removed from the air flow path.

Referring to FIGS. 1 and 2, a portion of an AHU 10 includes pairs of coil banks 12, 14, 16, 18, 20, 22, a housing 24, actuators 26, 28, 30, 32, 34, 36 (e.g., motors), and hydronic piping 38. Each of the coil banks 12, 14, 16, 18, 20, 22 includes respective headers 40, 42, 44, 46, 48, 50, 52, 54, 56, 58, 60, 62 and has a series of coils arranged to direct fluid from the hydronic piping 38 on one side of the coil bank to the hydronic piping 38 on the other side of the coil bank. The coil banks 12, 14, 16, 18, 20, 22 are arranged in layers such that ends of the coil banks 12, 14 are adjacent to each other in western-door style and define a first layer, ends of the coil banks 16, 18 are adjacent to each other in western-door style and define a second layer, and ends of the coil banks 20, 22 are adjacent to each other in western-door style and define a third layer. That is, the coils banks 12, 14 are rotatably mounted on ends opposite the ends that are adjacent to each other. The coil banks 16, 18 are fixedly mounted on ends opposite the ends that are adjacent to each other. And, the coil banks 20, 22 are rotatably mounted on ends opposite the ends that are adjacent to each other. Given this example arrangement, the coil banks 16, 18 swing open in one direction to reduce the amount of surface area positioned normal to the flow of air through the structure 24 (FIG. 2), and the coil banks 20, 22 swing open in the opposite direction to reduce the amount of surface area positioned normal to the flow of air through the structure 24 (FIG. 2). For reference, all of the coil banks 12, 14, 16, 18, 20, 22 are positioned normal to the flow of air through the structure 24 in FIG. 1.

The hydronic piping 38 includes ports 64, 66 and rotary unions 68, 70, 72, 74, 76, 78, 80, 82. The ports 64, 66 are in fluid communication with a fluid source (e.g., tank, etc.). The rotary union is 68 connected with the header 40. The rotary union 70 is connected with the header 42. The rotary union 72 is connected with the header 44. The rotary union 74 is connected with the header 42. The rotary union 74 is connected with the header 46. The rotary union 76 is connected with the header 56. The rotary union 78 is connected with the header 58. The rotary union 80 is connected with the header 60. The rotary union 82 is connected with the header 62. When the coil banks 12, 14 and/or coil banks 20, 22 swivel, the corresponding rotary unions remain sealed and permit fluid to continue to flow even though the coils banks are moving.

The portion of the AHU 10 further includes a controller 84. The controller 84 is in communication with/exerts control over the actuators 26, 28, 30, 32, 34, 36. Responsive to a command from a climate system for a reduced amount of cooling, the controller 84 may issue commands to cause one or more of the actuators 26, 28, 30, 32, 34, 36 to rotate their corresponding coil bank. The controller 84, for example, may issue a command to cause the actuators 26, 28 to swivel the coil bank 12 from the position shown in FIG. 1 to the position shown in FIG. 2. The controller 84, for example, may issue commands to cause the actuators 26, 28, 30, 32 to swivel the coil banks 12, 14 from the positions shown in FIG. 2 to the positions shown in FIG. 1, etc. This control may effectively introduce coil banks into or remove coil banks from the flow path of air through the structure 24 as needed.

It may be more efficient in certain circumstances for the coil banks 12, 14, 16, 18, 20, 22 to be positioned as shown in FIG. 1. It may be more efficient in other circumstances for the coil banks 12, 14, 16, 18, 20, 22 to be positioned as shown in FIG. 2. And, it may be more efficient in still other circumstances for some of the coil banks 12, 14, 16, 18, 20, 22 to be positioned as shown in FIG. 1 and other of the coil banks 12, 14, 16, 18, 20, 22 to be positioned as shown in FIG. 2.

The algorithms, methods, or processes disclosed herein can be deliverable to or implemented by a computer, controller, or processing device, which can include any dedicated electronic control unit or programmable electronic control unit. Similarly, the algorithms, methods, or processes can be stored as data and instructions executable by a computer or controller in many forms including, but not limited to, information permanently stored on non-writable storage media such as read only memory devices and information alterably stored on writeable storage media such as compact discs, random access memory devices, or other magnetic and optical media. The algorithms, methods, or processes can also be implemented in software executable objects. Alternatively, the algorithms, methods, or processes can be embodied in whole or in part using suitable hardware components, such as application specific integrated circuits, field-programmable gate arrays, state machines, or other hardware components or devices, or a combination of firmware, hardware, and software components.

While exemplary embodiments are described above, it is not intended that these embodiments describe all possible forms encompassed by the claims. A single actuator and associated gearing and linkages, for example, could be used to move several coil banks. A fewer or greater number of coil banks can be used depending on capacity requirements, etc. The words used in the specification are words of description rather than limitation, and it is understood that various changes may be made without departing from the spirit and scope of the disclosure. "Controller" and "controllers," for example, can be used interchangeably herein.

As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to strength, durability, life cycle, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A building air handling unit comprising:

a housing defining an air passageway; and a plurality of coil banks arranged in layers of adjacent pairs within the air passageway, at least one of the adjacent pairs being fixedly mounted with the housing to preclude rotation and at least another of the adjacent pairs being swivel mounted with the housing and configured to rotate relative to the housing to alter orientation of the at least another of the adjacent pairs relative to flow of air through the air passageway.

2. The building air handling unit of claim 1, wherein some of the at least another of the adjacent pairs rotate in a first direction and other of the adjacent pairs on a side of the at least one of the adjacent pairs opposite the at least another of the adjacent pairs rotate in a direction opposite the first direction.

3. The building air handling unit of claim 1 further comprising hydronic piping associated with the housing and including rotary unions configured to deliver fluid to, or receive fluid from, the at least another of the adjacent pairs.

4. The building air handling unit of claim 1 further comprising a plurality of actuators associated with the housing, each of the actuators configured to rotate at least one of the coil banks.

* * * * *